US006871515B1

(12) United States Patent
Starbuck et al.

(10) Patent No.: US 6,871,515 B1
(45) Date of Patent: Mar. 29, 2005

(54) KNITTED LACE CONSTRUCTION

(75) Inventors: Michael Starbuck, Leicaster (GB); John Smedley, Nottinghamshire (GB)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/798,126

(22) Filed: Mar. 11, 2004

(51) Int. Cl.[7] ..... D04B 1/10
(52) U.S. Cl. ..... 66/169 R
(58) Field of Search ..... 66/169 R–189, 66/196, 197, 198, 25, 200, 202

(56) References Cited

U.S. PATENT DOCUMENTS 2,021,598 A * 11/1935 Gustav ..... 66/180
3,035,427 A * 5/1962 Chiodine ..... 66/200
3,956,906 A * 5/1976 Cassidy, Sr. ..... 66/42 R
4,941,331 A * 7/1990 Cournoyer et al. ..... 66/25
6,539,752 B1 * 4/2003 Apollonio ..... 66/215
6,662,599 B1 * 12/2003 Apollonio ..... 66/215

* cited by examiner

*Primary Examiner*—Danny Worrell
(74) *Attorney, Agent, or Firm*—Ohlandt, Greeley, Ruggiero & Perle, L.L.P.

(57) ABSTRACT

A garment provides a weft knitted fabric having an open fabric effect that is sufficiently stable against run-back to enable the fabric to be used as a garment fabric. Also, the garment provides a weft knitted fabric that is stable against run-back and may be knit from lightweight yarns to produce a fabric having a lace-like characteristics, such as visually looking like lace and having a similar weight per unit area as lace.

14 Claims, 2 Drawing Sheets

KNITTED LACE CONSTRUCTION

BACKGROUND OF THE INVENTION

1. Field of the Invention

The present invention relates to a weft knitted lace. In particular, the present invention relates to a lace knitted on a circular knitting machine.

2. Description of Related Art

Production of weft knitted fabrics having holes to provide an open fabric effect are known. Such fabrics are produced by pressing-off loops to create holes in the fabric.

These fabrics tend to be vulnerable to run-back due to the pressed-off loops being pulled through the previous loop, particularly when the fabric is stretched in the course-wise direction. Accordingly this type of knitted fabric, although having aesthetic appeal, suffers the disadvantage of not being stable for use where the fabric is exposed to repeated stretching, such as for example where the fabric is used as a garment fabric.

BRIEF SUMMARY OF THE INVENTION

A general aim of the present invention is to provide a weft knitted fabric having an open fabric effect that is sufficiently stable against run-back to enable the fabric to be used as a garment fabric.

A further aim of the present invention is to provide a weft knitted fabric, which is stable against run-back and which may be knit from lightweight yarns to produce a fabric having lace-like characteristics, such as visually looking like lace and having a similar weight per unit area as lace.

BRIEF DESCRIPTION OF THE DRAWINGS

Various aspects of the present invention are hereinafter described with reference to the accompanying drawings, in which.

DETAILED DESCRIPTION OF THE INVENTION

Figure 1:
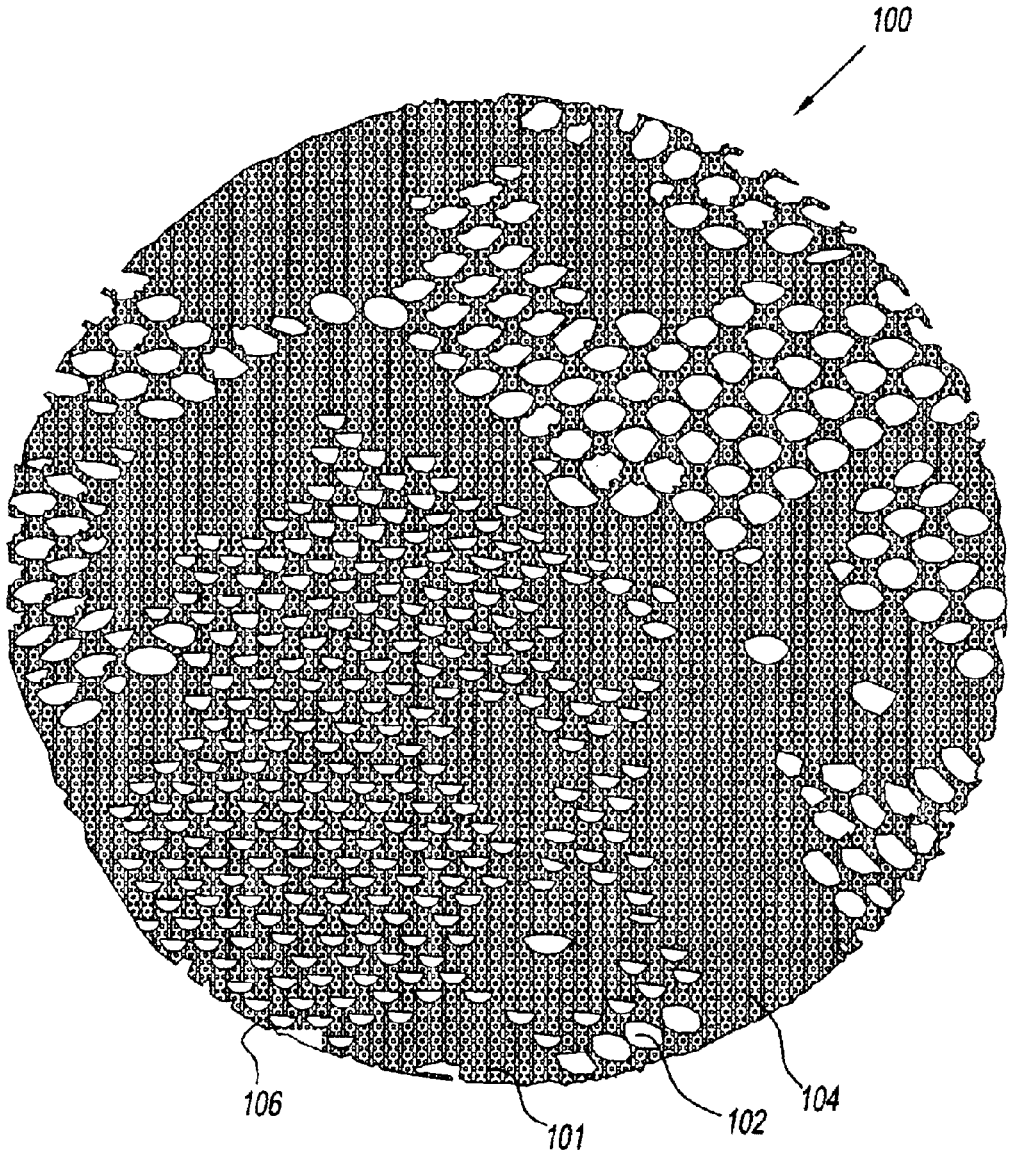
FIG. 1 is a photograph of a portion of weft knitted fabric according to an embodiment of the present invention.

The fabric 100 of a preferred embodiment of the present invention is shown in FIG. 1. The example embodiment in FIG. 1 has misknit (1×1) 101 and several kinds of lace holes: lace holes 5 pressed off loops separated by 3 wale construction ($W_c$) 102, lace holes 1 pressed off loop separated by 3 wale construction ($W_c$) 104, and lace holes 3 pressed off loops separated by 3 wale construction ($W_c$) 106. This fabric 100 is preferably knit on a multi feed circular knitting machine, such as an 8 feed circular knitting machine supplied by Santoni S.p.A.

The fabric 100 is a very open fabric of lightweight yarns and, as seen, has the appearance of a "true lace".

In this application, a "true lace" is a fabric that is normally made of two sets of yarns, viz. a set of ground yarns and a set of patterning yarns, which are knit on a warp knitting machine (typically a Rescelle machine) to produce the lace. The ground yarns are knit to produce an open ground fabric and the patterning yarns are laid into the ground fabric in selected areas in order to define a pattern, such as a floral pattern, overlying the ground fabric. The open ground fabric located in the regions not overlaid with patterning yarns are visible but the knitted structure for the ground fabric and choice of yarns is usually such as to render the regions of the ground fabric visibly indistinct so as to emphasise the visual distinctiveness of the patterned areas created by the patterning yarns.

It will be noted that in the fabric 100 shown in FIG. 1, a visual effect similar to a true lace has been created, viz. a very open knitted structure having visually distinct regions defining a pattern interspersed with an array of visually indistinct regions (defined by holes in the fabric). In other words, in the fabric 100 of FIG. 1, the knitted stitches define the visually distinct regions normally associated with the patterning yarns in a true lace, and the holes define visually indistinct regions normally associated with the open ground structure of a true lace.

In accordance with the preferred embodiment, the fabric 100 is a lightweight fabric, preferably having a weight in the range of 40 to 70 gm/m$^2$. In order to achieve this weight range, all yarns used for knitting fabric 100 are lightweight yarns having a yarn count of 100 dtex or less. The lighter the yarn weight, the finer, more delicate, the appearance of the fabric. This is taken into account when wishing to achieve a fine, delicate lace effect.

In accordance with the preferred embodiment of the invention, the lace appearance of the fabric 100 is achieved by pressing off stitches during weft knitting to create holes of predetermined sizes in the fabric at predetermined locations. The size of a given hole in the fabric is determined by the number of adjacent stitches pressed-off whilst knitting a given course.

By suitable choice of the size of adjacent holes and their dispositions within the fabric, it is possible to create a desired pattern composed of knitted/pressed-off stitches.

Figure 2:
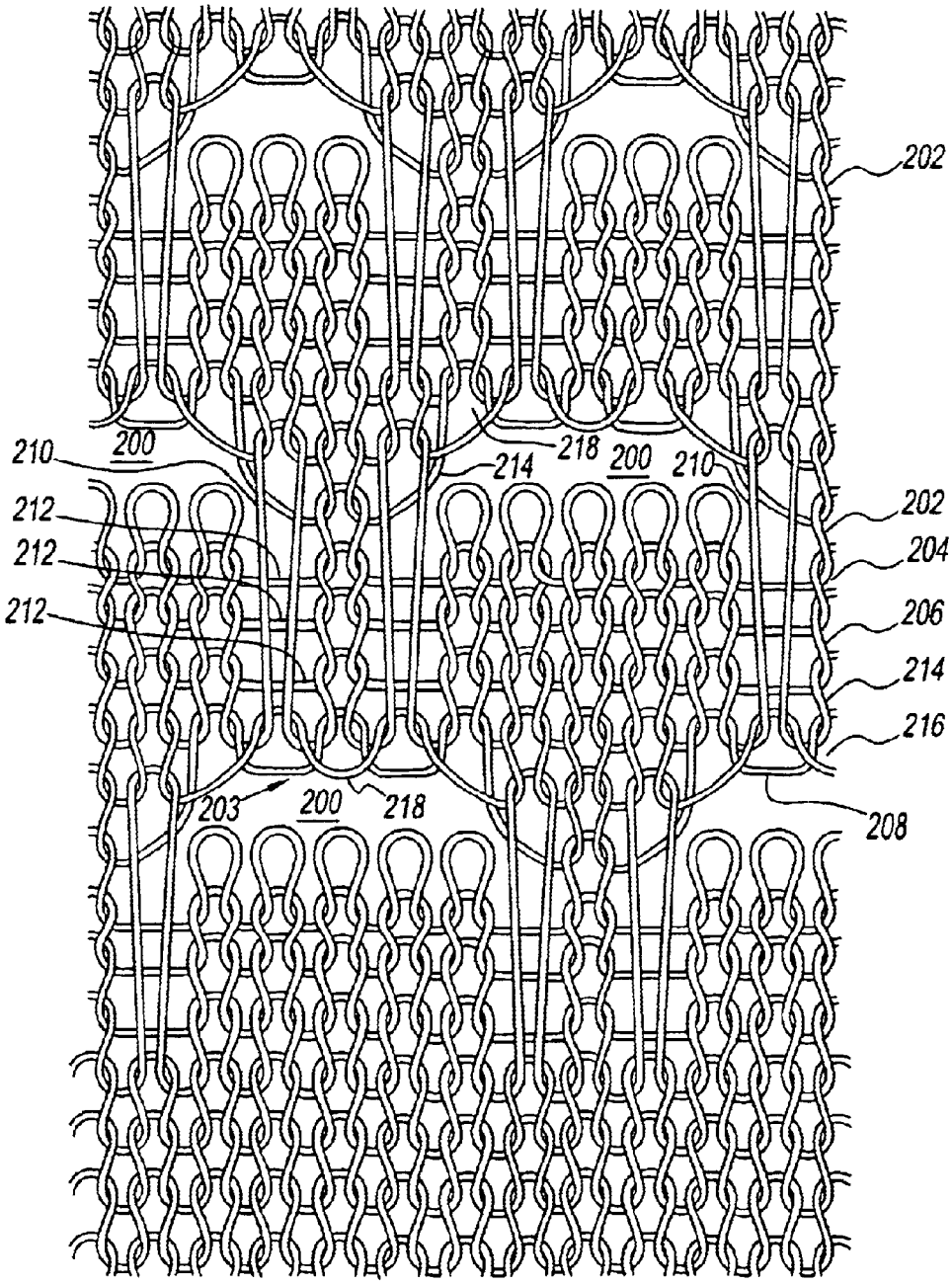
FIG. 2 is a stitch diagram illustrating the knitted structure of a portion of the fabric shown in FIG. 1.

A weft knitted fabric structure suitable for creating the lace fabric 100 of FIG. 1 is illustrated by way of example in FIG. 2.

As seen in FIG. 2, several holes 200 are illustrated in the 'as knitted' condition. In practice, after the fabric leaves the knitting machine, tensions in the yarns cause the fabric to define the kind of holes 200 shown in FIG. 1 as the fabric relaxes.

It will be noted that on a given course in which a hole 200 is to be produced, a number of adjacent stitches are pressed-off to define the 'bottom' edge of the hole. On the next course, a 'run-on' course is knitted and this defines the 'upper' edge of the hole 200.

In order to produce fabric 100 several or all of the following techniques and yarn combinations as identified in subsections (i) to (vi) are preferably adopted, viz.

i) Slack Loops for Pressing Off.

The course 202 having pressed off loops is preferably knit with low tension relative to the tension applied on the preceding course in order to produce elongated loops having a relatively long neck. The long neck provides two functions, viz. (1) it provides ample yarn for gripping by the preceding course (the anchor course 204), and (2) if pulled, a longer length of yarn is present to resist the pressed-off loop being pulled out of the knitted loop on the anchor course 204.

The yarn chosen for course 202 is preferably a nylon yarn (preferably textured to provide more bulk for resisting pull through of the pressed off loop). Preferably the yarn chosen for course 202 is textured yarn between 30 and 200 dtex.

ii) Anchorage Course 204

Preferably, course 204 provides a grip for the neck of the pressed off loops in order to grip the neck as tightly as possible to resist pull through of the pressed off loops on course 202.

Preferably, gripping of the pressed off loop on course 202 is achieved by (1) selection of the type of yarn for course 204 and/or (2) tension applied when knitting course 204.

Selection of yarn for course 204: This is preferably a hairy yarn such as cotton (preferably 40–80 cotton count). This type of yarn tends to shrink after knitting (to enhance the grip) and its hairy nature also enhances its frictional grip on the neck of the pressed-off loop on course 202.

Applied tension: this is preferably at least 50% greater than the tension applied when knitting course 202 in order to produce a very tight loop for gripping the loop neck of the pressed off loops on course 202.

iii) Anchorage Course 206

Preferably, the course 206 immediately preceding course 204 is also utilised to act to anchor the pressed-off loops on course 202.

Accordingly, course 206 is preferably knit to produce, in combination with course 204, a stabilised boundary along the lower course-wise edge of a lace hole 200.

This stabilised boundary is preferably achieved by knitting course 206 tightly (i.e. at a similar tension to course 204) and/or physically locking the stitches in courses 204 and 206 together. The yarn used for knitting course 206 may be of any type of yarn, i.e. it does not need to be a hairy yarn such as cotton.

Preferably, the yarn used for knitting course 206 is a continuous filament yarn of between 30 and 200 dtex.

iv) Locking of Courses 204, 206

In order to 'lock' courses 204, 206 to prevent run back, the yarns of both courses 204, 206 are preferably plated with a bare elastomeric yarn, such as Lycra, which is capable of being heat set and of being fused with itself at points of contact during the heat setting process.

Accordingly, after heat setting, the bare Lycra has in effect bonded to itself on courses 204, 206 and so is secured against run back.

v) Minimising Pulling Forces on the Press-Off Loops in the Course-Wise Direction During stretching of the fabric, there is a tendency for the pressed off loops to be exposed to pulling forces in the course-wise direction, which encourage these loops to be shortened and pulled through the anchoring loops of course 204.

In order to reduce these forces, and thereby render the fabric more resistant to run back caused by repeated stretching of the fabric (such as in wear or washing), a stretch resistant wale construction 208 is provided at each course-wise end of each lace hole 200.

The wale construction 208 includes a held loop 210, which extends over at least three courses to form at least three float stitches 212 formed in adjacent courses (202, 204 and 206). Adjacent to the held loop 210 is a wale of knitted stitches 218.

Accordingly, pulling forces applied when the fabric is stretched in the course-wise direction is shared equally by the three float stitches 212 and so reduces the pulling force that is applied onto course 202.

It follows, therefore, that holes 200 in the wale-wise direction are separated by at least 5 adjacent courses (viz. courses 202, 204, 206, a course 214 for forming the held loops 210, and a run on course 216) and that in the course-wise direction, adjacent lace holes 200 are separated by a wale construction 208 having at least three wales (viz. a held loop 210 immediately adjacent to one lace hole 200, a held loop 210 immediately adjacent to the neighbouring lace hole 200, and at least one wale of knitted stitches 218 between the two held loops 210).

vi) Size of Lace Hole 200

The upper course-wise boundary of each hole 200 is preferably defined by a conventional (1×1 knit-miss-knit) run-on course 216. Accordingly the number of stitches defining the upper boundary is (n+1) where n is zero or an even number (2, 4, 6 . . . ).

Preferably, the yarns used for the run-on course 216 are nylon textured or flat polyester (yarn or continuous filament) in construction.

vii) Reliable Press-Off

In order to ensure reliable press-off of the loops on course 202, the same needle is preferably exposed to a pressing off action at two successive feeds. Thus on a Santoni 8 feed machine, the needle cams at two adjacent feeds are used to press-off stitches and only 6 feeds are used to supply yarn to be knit.

By using all or some of the technique/yarn combinations as described in paragraphs (iv) to (vii) above, it is possible to produce a weft knitted fabric having a true lace appearance that is stable against run-back of the pressed-off stitches that form holes 200.

By adopting a desired distribution of holes 200 within the fabric and selecting the size of these holes, it is possible to define desired patterns. In the fabric 100 shown in FIG. 1, areas of 'dense' fabric 50 are created adopting a 1×1 miss-knit knitted structure. Areas 60 are produced by holes 200 defined by 1 pressed-off stitch separated by a 3 wale construction 208. Areas 70 are produced by holes 200 defined by 3 pressed-off stitches separated by a 3 wale construction 208. Areas 80 are produced by holes 200 defined by 5 pressed-off stitches separated by a 3 wale construction 208.

Although not shown in the fabric 100 of FIG. 1, it will be appreciated that regions of plain jersey knit may also be incorporated in selected areas of the fabric.

What is claimed is:

1. A weft knitted fabric, comprising:

a plurality of visually distinct regions; and a plurality of visually indistinct regions interspersed with said plurality of distinct regions, said plurality of visually indistinct regions being defined by holes in the fabric, each hole having a lower course-wise edge defined by one or more consecutive pressed-off loops on a first course, an upper course-wise edge defined by a second course succeeding said first course, and a pair of walewise constructions located adjacent to the pressed-off loops to define the course-wise extent of one of said holes, each wale construction being of a miss-knit structure having immediately adjacent the hole a held loop extending between a third course preceding said first course and the second course or a course succeeding the second course.

2. The fabric according to claim 1, wherein said third course is spaced from said first course by at least one intermediate course.

3. The fabric according to claim 1, wherein said third course is spaced from said first course by two intermediate courses.

4. The fabric according to claim 3, wherein said first course is knit under low tension and a course immediately preceding said first course is knit under high tension to define an anchorage course.

5. The fabric according to claim 4, wherein the yarn which ends said first course has a yarn that ends said first course, said yarn being textured.

6. The fabric according to claim 4, wherein the anchorage course is knit using a yarn capable of frictionally gripping the pressed-off loops on said first course.

7. The fabric according to claim 4, wherein the yarn from which the anchorage course is knit comprises a non-stretch yarn plated with a bare elastomeric yarn.

8. The fabric according to claim 7, wherein the anchorage course and wherein the course immediately preceding the anchorage course is knit with a non-stretch yarn plated with a bare elastomeric yarn.

9. The fabric according to claim 8, wherein the fabric is heat set to cause the bare elastomeric yarn on the anchorage course and the course immediately preceding the anchorage course to bond to itself at points of contact.

10. A weft knit fabric, comprising:

a plurality of visually distinct regions; and a plurality of visually indistinct regions interspersed with said plurality of visually distinct regions, said plurality of visually indistinct regions being defined by holes in the fabric, each hole having a lower course-wise edge defined by one or more consecutive pressed-off loops on a first given course, an upper course-wise edge defined by a second course succeeding said first course, said first course being knit under a low tension and the two courses immediately preceding said first course being knit under a high tension, at least one of said two courses being knit from a non-stretchable yarn plated with a bare elastomeric yarn.

11. The fabric according to claim 10, wherein both of said two courses are knit from a nonstretchable yarn plated with a bare elastomeric yarn.

12. The fabric according to claim 11, wherein the fabric is heat set to cause the bare elastomeric yarn to bond at points of contact on said two courses.

13. The fabric according to claim 12, wherein the non-stretchable yarn used to knit a course immediately preceding the first course is cotton or similar hairy yarn.

14. A weft knit garment, comprising:

a plurality of visually distinct regions; and a plurality of visually indistinct regions interspersed with said plurality of visually distinct regions, said plurality of visually indistinct regions being defined by holes in the fabric such that an open fabric effect is achieved, said open fabric effect being stable against run-back of the weft knit garment, said fabric being knit from a lightweight yarn to visually look like lace and have substantially similar weight per unit as lace.

* * * * *